US005888950A

United States Patent [19]

Potini et al.

[11] Patent Number: 5,888,950

[45] **Date of Patent: *Mar. 30, 1999**

[54] ALCOHOL-CONTAINING ABRASIVE COMPOSITION FOR CLEANING CONTACT LENSES

[75] Inventors: Chimpiramma Potini, Methuen; Stanley J. Wrobel, Andover, both of Mass.

[73] Assignee: Wilmington Partners LP, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 752,423

[22] Filed: Nov. 19, 1996

Related U.S. Application Data

[60] Continuation of Ser. No. 469,257, Jun. 6, 1995, abandoned, which is a division of Ser. No. 275,918, Jul. 15, 1994, abandoned, which is a continuation of Ser. No. 32,928, Mar. 18, 1993, abandoned.

[51] Int. Cl.[6] ..... C11D 1/83; C11D 3/14

[52] U.S. Cl. ..... 510/113; 510/421; 510/475; 510/511; 134/7

[58] Field of Search ..... 510/112, 113, 510/115, 475, 511, 421, 1; 134/7

[56] References Cited

U.S. PATENT DOCUMENTS

| | | | |
|---|---|---|---|
| 3,206,408 | 9/1965 | Vitalis | 252/161 |
| 3,711,414 | 1/1973 | Hewitt | 252/118 |
| 3,928,249 | 12/1975 | Nunziata | 252/526 |
| 4,046,706 | 9/1977 | Krezanoski | 252/106 |
| 4,284,533 | 8/1981 | Imamura | 252/542 |
| 4,302,364 | 11/1981 | Gosset et al. | 252/545 |
| 4,374,745 | 2/1983 | Sibley | 252/106 |
| 4,394,179 | 7/1983 | Ellis | 134/7 |
| 4,421,665 | 12/1983 | Lloyd | 252/106 |
| 4,578,119 | 3/1986 | Marcus | 134/4 |
| 4,655,957 | 4/1987 | Chromecek | 252/163 |
| 4,767,563 | 8/1988 | Buzzaccarini | 252/559 |
| 4,772,425 | 9/1988 | Chirash | 252/547 |
| 5,037,484 | 8/1991 | Stebbins | 134/7 |
| 5,089,053 | 2/1992 | Chou | 134/7 |
| 5,167,871 | 12/1992 | Jollenbeck | 252/543 |
| 5,298,182 | 3/1994 | Tsao | 252/106 |

FOREIGN PATENT DOCUMENTS

| | | | |
|---|---|---|---|
| 57168218 | 8/1991 | Japan | G02C 13/00 |
| 94/21774 | 9/1994 | WIPO . | |

OTHER PUBLICATIONS

Product literature published by CIBA Vision for MiraFlow® Extra–Strength Daily Cleaner.

*Primary Examiner*—Margaret Einsmann
*Attorney, Agent, or Firm*—Chris P. Konkol

[57] ABSTRACT

An aqueous composition for cleaning contact lenses comprises an aliphatic monohydric alcohol, a surface active agent having cleaning action for contact lens deposits, and an abrasive agent.

1 Claim, No Drawings

ALCOHOL-CONTAINING ABRASIVE COMPOSITION FOR CLEANING CONTACT LENSES

This is a continuation application of application Ser. No. 08/469257, filed Jun. 6, 1995, which is a divisional of application Ser. No. 08/275,918 filed on Jul. 15, 1994, now abandoned, which is a continuation of Ser. No. 08/032,928 filed on Mar. 18, 1993, now abandoned.

BACKGROUND OF THE INVENTION

This invention relates to a composition for cleaning contact lenses. The composition comprises an aliphatic monohydric alcohol, a surface active material having cleaning action for contact lens deposits, and an abrasive agent.

The tendency of contact lens materials to form deposits necessitates regular cleaning of the contact lenses. Deposits from the tear film include protein, lipid and mucin, and deposits from external sources include cosmetic deposits, such as from mascara or hair spray, or materials deposited when the lens is handled.

Enzymatic contact lens cleaners are frequently used to remove protein deposits, especially denatured proteins, particularly with hydrophilic soft contact lenses for which protein is the major deposit problem. However, enzymatic cleaners are not particularly effective for other types of deposits.

Surfactant contact lens cleaners, which employ a surface active agent having cleaning action, are used to remove lipid deposits, loosely bound protein deposits, and other deposits. Surfactant cleaners are used in conjunction with finger rubbing or other mechanical cleaning, followed by rinsing to remove the deposits. Surfactant cleaners are used for hard and soft contact lenses. Hard lenses include polymethylmethacrylate lenses and rigid gas permeable lenses formed of a silicon acrylate or a fluorosilicon acrylate polymer. Soft lenses include hydrophilic hydrogel lenses.

Various surfactant contact lens cleaners which employ an alcohol, such as ethanol or isopropanol, are known. A commercial product marketed by CIBA Vision (Atlanta, Ga., USA) as an "extra-strength" contact lens cleaner is MiraFlow® Extra-Strength Daily Cleaner. This cleaner includes, as principal active ingredients: isopropanol; poloxamer 407 (a polyoxyethylene, polyoxypropylene block copolymer such as available under the trade name Pluronic F-127); and an amphoteric imidazole surfactant. Similar compositions are disclosed in U.S. Pat. No. 4,046,706 (Krezanoski).

Additionally, U.S. Pat. No. 4,421,665 (Lloyd et al.) discloses alcohol-containing contact lens cleaning solutions comprising: a non-polar solvent in the form of cyclohexane and/or ethyl acetate, and optionally. trace amounts of chloroform; ethanol or isopropanol as a polar solvent; and a surfactant. The surfactant is preferably a nonionic surfactant, although dioctylsulfosuccinate is also disclosed. The patent discloses that the non-polar solvent is adapted to provide for enhanced solubility of lipids and lipoproteins, and the alcohol has the ability to dissolve fully the non-polar solvents and potentiate their anti-microbial activity. However, the use of non-polar solvents such as cyclohexane, ethyl acetate, and chloroform in a contact lens solution is undesirable in case the composition is not adequately rinsed from the lens.

A challenge is to develop alcohol-containing contact lens cleaning compositions which not only provide the desired cleaning efficacy, but which also are suitable for ophthalmic use and are less damaging to the lenses. Efforts to develop alcohol-containing contact lens cleaning compositions often lead to compositions which damage the lens; for example, use of the compositions in a cleaning regimen may result in scratching of the lens surfaces, or deterioration of the lens such that the power of the lens is changed.

SUMMARY OF THE INVENTION

This invention provides an aqueous composition for cleaning contact lenses which comprises an aliphatic monohydric alcohol, a surface active agent having cleaning action for contact lens deposits, and an abrasive agent. Additionally, the invention relates to methods of cleaning contact lenses which employ the composition.

The alcohol-containing compositions provide the desired cleaning activity, yet are less damaging to lenses than the known commercial alcohol-containing cleaner, as well as other alcohol-containing compositions lacking an abrasive agent.

DETAILED DESCRIPTION OF THE INVENTION

The cleaning composition of the invention is an aqueous composition which includes an aliphatic monohydric alcohol. Preferred alcohols include $C_{2-6}$ monohydric alkanols, with ethanol and isopropanol being especially preferred. The alcohol component is preferably present in the composition at about 5 to about 40 weight percent in order to provide adequate cleaning efficacy. According to preferred embodiments, the alcohol component is employed at about 7.5 to about 20 weight percent, and more preferably at about 7.5 to about 15 weight percent.

The composition also includes at least one surface active agent having cleaning action .for contact lens deposits. The surface active agent may include anionic surfaces active agents, nonionic surface active agents, cationic surface active agents, amphoteric surface active agents, and mixtures thereof.

Preferred surface active agents are anionic surface active agents having cleaning action for contact lens deposits. Representative anionic surface active agents include sulfated and sulfonated surface active agents, and physiologically acceptable salts thereof. Such anionic surface active agents may be represented by the general formulae:

$$ROSO_3^-M \quad (I)$$

and $$RSO_3^-M \quad (II)$$

wherein: $R^1$ is an organic radical including a $C_6$–$C_{20}$ alkyl or alkenyl group; and M is selected from the group consisting of H and physiologically acceptable salts such as $Na^+$, $K^+$, $NH_4^+$, ½ $Mg^+$and $(CH_2CH_2OH)_3NH^+$.

More specifically, the anionic surface active agent includes materials represented by the following general formula:

$$R^1(OCH_2CH_2)_nOSO_3^-M \quad (III)$$

wherein: $R^1$ is selected from the group consisting of $C_6$–$C_{20}$ alkyl and alkenyl; n has a value in the range of 0 to 10; and M is selected from the group consisting of H and physiologically acceptable salts such as $Na^+$, $K^+$, $NH_4^+$, ½ $Mg^+$and $(CH_2CH_2OH)_3NH^+$. Examples include sodium lauryl sulfate, sodium laureth sulfate (sodium salt of sulfated ethoxylated lauryl alcohol), ammonium laureth sulfate (ammonium salt of sulfated ethoxylated lauryl alcohol), sodium cetyl sulfate, sodium octyl sulfate, sodium tridecyl sulfate, sodium trideceth sulfate (sodium salt of sulfated ethoxylated tridecyl alcohol), triethanolamine lauryl sulfate, and magnesium lauryl sulfate.

Other anionic surface active agents include materials represented by the following general formulae:

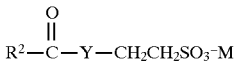

(IV)

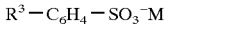

(V)

wherein each of $R_2$ and $R_3$ is selected from the group consisting of $C_6$–$C_{20}$ alkyl and alkenyl; Y is selected from the group consisting of —O— and —N($CH_3$)—; and M is selected from the group consisting of H and physiologically acceptable salts such as $Na^+$, $K^+$, $NH_4^+$, ½ $Mg^+$and $(CH_2CH_2OH)_3NH^+$. Examples include sodium methyl cocoyl taurate (sodium salt of the coconut fatty acid amide of N-methyltaurine), sodium methyl oleoyl taurate (sodium salt of the oleic acid amide of N-methyltaurine), and sodium dodecylbenzene sulfonate.

Further anionic surface active agents include materials represented by the following general formulae:

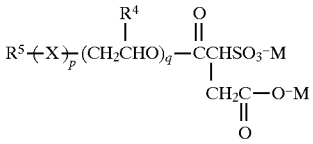

(VI)

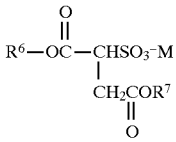

(VII)

wherein $R^4$ is selected from the group consisting of H and methyl; each of $R^5$, $R^6$ and $R^7$ is selected from the group consisting of $C_6$–$C_{20}$ alkyl and alkenyl; —X— is selected from the group consisting of —O— and —CONH—; p is 0 or 1; q has a value within the range of 1 to 6; and each M is independently selected from the group consisting of H and physiologically acceptable salts such as $Na^+$, $K^+$, $NH_4^+$, ½ $Mg^+$and $(CH_2CH_2\ _{OH})_3NH^+$. Examples include disodium lauryl sulfosuccinate (disodium salt of a lauryl alcohol half ester of sulfosuccinic acid), disodium lauramido MEA-sulfosuccinate (disodium salt of a lauryl-substituted monoethanolamide half ester of sulfosuccinic acid), disodium laureth sulfosuccinate (disodium salt of an ethoxylated lauryl alcohol half ester of sulfosuccinic acid), disodium oleamido MEA-sulfosuccinate (disodium salt of an oleyl-substituted monoethanolamide half ester of sulfosuccinic acid), disodium oleamido MIPA-sulfosuccinate (disodium salt of an oleyl-substituted isopropanolamide half ester of sulfosuccinic acid), and dioctyl sodium sulfosuccinate (sodium salt of the diester of a 2-ethylhexyl alcohol and sulfosuccinic acid).

Commercially available anionic surface active agents include those available under the following tradenames: Tauranol WS (sodium methyl cocoyl taurate, available from Finetex, Inc., Elmwood Park, N.J., USA); Varsulf SBFA-30 ($C_{12}$–$C_{14}$ fatty alcohol ethoxylated sulfosuccinate, available from Sherex Chemical Co., Dublin, Ohio, USA); Standapol SCH-101 (a mixture including disodium oleamido sulfosuccinate and sodium lauryl sulfate, available from Henkel, Inc., Hoboken, N.J., USA); Steol-7N (sodium laureth sulfate, available from Stepan Chemical Co. Surfactant Dept., Northfield, Ill., USA); Sipex EST-30 (sodium trideceth sulfate, available from Rhone-Poulenc, Cranbury, N.J., USA); products available under the tradename Bio Soft which include sodium dodecylbenzene sulfonate (available from Stepan Chemical Co.); and Surfine WNT-A (sodium pareth-25-7-carboxylate, available from Finetex, Inc.). Other suitable anionic surface active agents would be evident to one skilled in the art.

The compositions may include the anionic surface active agent at about 0 to about 30 weight percent. According to preferred embodiments, the compositions contain about 0.1 to about 30 weight percent of the anionic surface active agent, more preferably about at about 0.5 to about 15 weight percent, with 1 to about 10 weight percent being especially preferred.

Another preferred class of surface active agents is nonionic surface active agent having cleaning action for contact lens deposits. Representative nonionic surface active agents include poloxamer surface active agents, such as the surface active agents available under the trade name Pluronic from BASF Wyandotte Corp., Parsippany, N.J., USA. The poloxamer surface active agents are polyoxyethylene, polyoxypropylene block copolymers that conform generally to the formula:

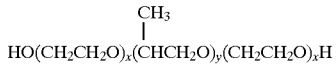

(VIII)

wherein x and y designate the average units of polyoxyethylene and polyoxypropylene, respectively.

Other representative nonionic surface active agents include ethoxylated alkyl phenols, such as various surface active agents available under the trade names Triton (Union Carbide, Tarrytown, N.Y., USA) and Igepal (Rhone-Poulenc). The ethoxylated alkyl phenols generally conform to the formula:

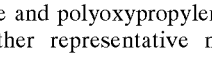

(IX)

wherein: $R^8$ is $C_6$–$C_{20}$ alkyl, preferably $C_8$–$C_9$ alkyl; and r has a value within the range of 3 to 12, preferably from 9 to 10.

Further nonionic surface active agents include ethanolamides and diethanolamides of the formulae:

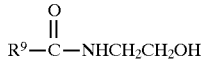

(X)

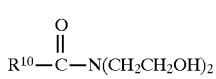

(XI)

wherein each of $R^9$ and $R^{10}$ is $C_6$–$C_{20}$ alkyl or alkenyl, preferably cocoamide DEA (a mixture of diethanolamides of coconut acid) and cocoamide MEA (a mixture of diethanolamides of coconut acid). Commercial products include those available under the tradename Carsamide (Lonza Chemical Co., Fairlawn, N.J., USA) or Witcamide (Witco Chemical Corp., New York, N.Y., USA).

Preferred are nonionic surface active agents which contain polyoxyethylene moieties, such as the polyoxyethylene, polyoxypropylene block. copolymers and the ethoxylated alkyl phenols, as these agents appear to provide some degree of lubricity or wettability when used to clean contact lenses.

The composition may include one or more nonionic surface active agents at amounts from 0 to about 30 weight percent, more preferably at about 0.1 to about 25 weight percent, with about 2 to about 10 weight percent being especially preferred.

Another class of surface active agents are cationic surface active agents having cleaning action for-contact lens deposits. Representative cationic surface active agents include triquaternary phosphate esters, such as various cationic surface active agents available from Mona Industries, Inc., Patterson, N.J., USA under the tradename Monaquat. Generally, the cationic surface active agent may be employed at 0 to about 5 weight percent. When present, the cationic surface active agent is preferably employed at about 0.001 to about 5 weight percent.

The compositions may include an amphoteric surface active agent, generally at about 0 to about 20 weight percent. Known amphoteric surface active agents include imidazole amphoterics, such as those disclosed in U.S. Pat. No. 4,046,706. Various amphoterics are available under the tradename Miranol from Rhone-Poulenc, such as products containing lauroamphocarboxyglycinate. When present, the amphoteric surface active agent is preferably employed at about 0.01 to about 20 weight percent.

The total amount of the surface active agents in the composition may be about 0.1 to about 60 weight percent. Generally, smaller amounts may not provide adequate cleaning efficacy for certain deposits, whereas larger amount may make rinsing of lenses more difficult. Preferably, the composition includes about 1 to about 50 weight-percent, with about 5 to about 25 weight percent being especially preferred.

The cleaning compositions include an abrasive agent. The abrasive provides enhanced cleaning efficacy, especially for more difficult to remove deposits. Additionally, alcohol-containing contact lens cleaners tend to be harsh on lenses. It has been found that lenses cleaned with the alcohol-containing abrasive cleaner of the present invention have less scratching than lenses cleaned with comparable alcohol-containing cleaners lacking an abrasive agent.

The abrasive agent is a material containing water-insoluble particles, including inorganic particles or natural or synthetic polymeric particles. Preferably, the particles of the abrasive agent have an average particle size under about 20 microns ($20\times10^{-6}$ m), and more preferably an average particles size of about 0.5 to about 5 microns. Inorganic abrasive particles include: alumina; silica, including amorphous silica or synthetic silica such as silica gel; aluminum silicate; titanium dioxide; and .zirconium oxide. Particulate polymers include polymethylmethacrylate, nylons, cellulose acetate butyrate, polyvinylchloride and polycarbonate.

The abrasive agent is preferably employed at 0.1 to about 20 weight percent, more preferably at about 0.1 to about 10 weight percent, with about 0.1 to about 5 weight percent being especially preferred.

The compositions may further include a suspending agent to provide a stable suspension of the abrasive in the composition. (Otherwise, the compositions may be shaken prior to use to suspend the abrasive agent.)

Representative abrasive agents and suspending agents are described in detail in U.S. Pat. Nos. 4,394,179 (Ellis) and 5,089,053 (Chou et al.), the disclosures of which are incorporated herein by reference.

Preferred suspending agents include-polymeric viscosifying agents effective for increasing the viscosity of an alcohol-containing aqueous solution, such. as crosslinked polymers of acrylic acid or natural gums. The suspending agent may be present at 0 to about 20 weight percent. When present, the suspending agent is preferably employed at about 0.1 to about 20 weight percent.

The cleaning compositions include as necessary buffering agents for buffering or adjusting pH of the composition, and/or tonicity adjusting agents for adjusting the tonicity of the composition. Representative buffering agents include: alkali metal salts such as potassium or sodium carbonates, acetates, borates, phosphates, citrates and hydroxides; and weak acids such as acetic, boric and phosphoric acids. Representative tonicity adjusting agents include: sodium and potassium chloride, and those materials listed as buffering agents. The tonicity agents may be employed in an amount effective to adjust the osmotic value of the final composition to a desired value. Generally, the buffering agents and/or tonicity adjusting agents may be included up to about 10 weight percent.

Additionally, the compositions may include wetting agents. Representative wetting agents include: cellulose derivatives, such as cationic cellulosic polymers, hydroxypropyl methylcellulose, hydroxyethylcellulose and methylcellulose; polyethyleneoxy-containing polymers (in addition to the above-described nonionic surfactants containing polyoxyethylene moieties), such as polymers of polyethylene glycol; polyvinyl alcohol; and polyvinyl pyrrolidone. Such additives may be used in a wide range of concentrations as is known in the art.

The aliphatic monohydric alcohol component provides some preservative efficacy for maintaining sterility of the composition. Generally, when the alcohol is included in an amount of about 7.5 weight percent or higher, the cleaning composition is self-preserving. However, an optional preservative may be included in the composition in an antimicrobially effective amount, i.e., an amount which is effective to at least inhibit growth of microorganisms in the composition. Various antimicrobial agents are known in the art as useful in contact lens solutions, including: chlorhexidine (1,1'-hexamethylene-bis[5-(p-chlorophenyl) biguanide]) or water soluble salts thereof, such as chlorhexidine gluconate; polyhexamethylene biguanide (a polymer of hexamethylene biguanide, also referred to as polyaminopropyl biguanide) or water-soluble salts thereof, such as the polyhexamethylene biguanide hydrochloride available under the trade name Cosmocil CQ (ICI Americas Inc.); benzalkonium chloride; and polymeric quaternary ammonium salts. Such optional antimicrobial agents may be included at 0 to about 5 weight percent, depending on the specific agent.

The compositions may further include a sequestering agent (or chelating agent) which can be present up to about 2.0 weight percent. Examples of preferred sequestering agents include ethylenediaminetetraacetic acid (EDTA) and its salts, with the disodium salt (disodium edetate) being especially preferred.

Additionally, the cleaning composition may optionally include a fragrance. Particularly, in compositions including isopropanol, an odor masking agent may be added to mask the odor of isopropanol if desired.

A contact lens is cleaned by exposing the lens to the cleaning composition, preferably by immersing the lens in the composition, followed by agitation, such as by rubbing the cleaning solution on the lens surface. The lens is then rinsed to remove the composition along with contaminants. The compositions are useful in removing deposits including deposits more difficult to clean from a lens, and various compositions provide wettability to the lens. The compositions are useful to the lens lab practitioner for removing deposits formed during processing and handling of the lens. Additionally, the compositions are useful in a regular cleaning regimen by a contact lens wearer to remove surface deposits formed from the tear film as well as deposits from external sources such as cosmetics. The compositions provide the desired cleaning efficacy without excessive scratching and without changing the power of the lens.

Additionally, the cleaning compositions avoid the need to include nonpolar solvents, such as cyclohexane, ethyl acetate or chloroform required in the cleaning compositions of U.S. Pat. No. 4,421,665. It is believed that many such solvents, if not adequately rinsed from the lens, can be harmful or toxic to the lens wearer.

The following examples further illustrate preferred embodiments of the invention.

EXAMPLE 1

Contact lens cleaning compositions were prepared by mixing the components listed in Table 1. The principal active components of the commercial products are listed parenthetically, as well as concentration of the actives where applicable.

Pluronic F-127 was added with mixing to a measured amount of cold distilled water. After dissolution, about half the amount of isopropanol and the remaining components were added stepwise with mixing. The remaining isopropanol was added with mixing in a closed flask to avoid evaporation of isopropanol. Syloid-244, employed in .Composition 1, is the tradename for a gel containing synthetic amorphous silica having an average particle size of about 2.5 microns (available from W. R. Grace Co., Baltimore, Md., USA).

TABLE 1

| Component (Wt. %) | Cmpn 1 | Cmpn C1 |
|---|---|---|
| Isopropanol | 10.00 | 10.00 |
| Triton X-100 (Ethoxylated alkyl phenol) | 5.00 | 5.00 |
| Pluronic F-127 (Polyoxyethylene, polyoxypropylene block copolymer) | 15.00 | 15.00 |
| Tauranol WS (Sodium methyl cocoyl taurate, 40%) | 5.00 | 5.00 |
| Polyox WSR-301 (Polymer of ethylene oxide) | 0.10 | 0.10 |
| Syloid-244 | 2.00 | — |
| Titanium Dioxide | 0.75 | — |
| Glycerin | 0.20 | 0.20 |
| Distilled Water (qs to) | 100 | 100 |
| pH | 7.9 | 7.8 |

EXAMPLE 2

Six rigid gas permeable (RGP) lenses formed of a fluorosilicon acrylate polymer were subjected to a cleaning and conditioning regimen. Prior to the regimen, the basecurve, power and surface quality of each lens was measured. Initially, each lens had a comparable basecurve, power, and surface quality.

Each lens was initially conditioned with a commercial RGP conditioning (soaking and wetting) solution. Subsequently, each lens was subjected to 30 treatment cycles, wherein each cycle included: (1) treatment with a cleaning composition; followed by (2) treatment with the commercial conditioning solution. For the cleaning segment of the regimen, Lenses 1 and 2 were treated with MiraFlow® Extra-Strength Daily Cleaner (CIBA Vision Corp.), containing as principal active ingredients isopropanol, poloxamer 407 (a polyoxyethylene, polyoxypropylene block copolymer such as available under the trade name Pluronic F-127) and an amphoteric imidazole surfactant. Lenses 3 and 4 were treated with Composition Cl of Table 1. Lenses 5 and 6 were treated with the composition of this invention, Composition 1 of Table 1. For the conditioning segment of the regimen, each lens was treated with the same conditioning solution. Following the 30-cycle treatment regimen, the basecurve, power and surface quality of each lens were measured. The results are reported in Table 2, where the scratching of the cleaned lenses is ranked relative to the other lens groups.

TABLE 2

| | Basecurve | | Power | | Surface Quality | |
|---|---|---|---|---|---|---|
| Lens | Initial | Final | Initial | Final | Initial | Final |
| 1 | 7.89 | 8.03 | −2.75 | −2.75 | 0 | +++ |
| 2 | 7.96 | 8.01 | −2.75 | −2.75 | 0 | +++ |
| 3 | 8.02 | 8.03 | −2.75 | −2.75 | 0 | ++ |
| 4 | 7.98 | 8.00 | −2.75 | −2.75 | 0 | ++ |
| 5 | 7.98 | 8.01 | −2.75 | −2.75 | 0 | + |
| 6 | 7.96 | 8.01 | −2.75 | −2.75 | 0 | + |

0 Polished lens surface
+ Minor scratches
++ Moderate scratches
+++ Heavy scratches The lenses cleaned with the abrasive cleaning position of the present invention exhibited less face scratching than lenses cleaned with either the MiraFlow® Extra-Strength brand alcohol-containing cleaner or Composition Cl.

EXAMPLE 3

Pluronic F-127 was added with mixing to a measured amount of-cold distilled water. After dissolution, the other components listed in Table 3 (except for Carbopol 940, isopropanol and triethanolamine) were added stepwise with mixing. Carbopol 940 was added and dispersed with mixing at room temperature for about 30 minutes. Isopropanol was added with mixing in a closed flask to avoid evaporation. Triethanolamine was added slowly to the final composition. Carbopol 940 is the tradename of a crosslinked polymer of acrylic acid, B. F. Goodrich Chemical Co., Cleveland, Ohio, USA.

TABLE 3

| Component (Wt. %) | Cmpn 2 |
|---|---|
| Isopropanol | 10.00 |
| Triton X-100 | 5.00 |
| Pluronic F-127 | 5.00 |
| Tauranol WS | 5.00 |
| Polyox WSR-301 | 0.10 |
| Syloid-244 | 2.00 |
| Carbopol 940 | 0.50 |
| Glycerin | 0.20 |
| Triethanolamine | 0.80 |
| Distilled Water (qs to) | 100 |

Although certain preferred embodiments have been described, it is understood that the invention is not limited thereto and modifications and variations would be evident to a person of ordinary skill in the art.

We claim:

1. A method of cleaning a contact lens having contaminants thereon by rubbing said contact lens with an aqueous composition comprising:

(a) about 7.5 to about 15 weight percent of at least one member selected from the group consisting of ethanol and isopropanol;

(b) about 1 to 10 weight percent of a surface active agent selected from the group consisting of sulfonated and sulfated anionic surface active agents;

(c) about 2 to 25 weight percent of one or more non-ionic surface active agents selected from the group consisting of polyoxyethylene-polyoxypropylene block copolymers and ethoxylated alkyl phenols;

(d) about 0.1 to 5 weight percent of a water-insoluble abrasive agent selected from the group consisting of silica gel, titanium dioxide, and mixtures thereof, wherein the abrasive agent has an average particle size of about 0.5 to about 5 microns.

* * * * *